US011336053B2

(12) United States Patent
Sanders et al.

(10) Patent No.: US 11,336,053 B2
(45) Date of Patent: May 17, 2022

(54) DATA CARRIER ADAPTERS

(71) Applicant: Hewlett-Packard Development Company, L.P., Spring, TX (US)

(72) Inventors: Aaron Sanders, Houston, TX (US); John Burr, Houston, TX (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 8 days.

(21) Appl. No.: 16/481,986

(22) PCT Filed: Feb. 27, 2018

(86) PCT No.: PCT/US2018/019855
§ 371 (c)(1),
(2) Date: Jul. 30, 2019

(87) PCT Pub. No.: WO2019/168496
PCT Pub. Date: Sep. 6, 2019

(65) Prior Publication Data

US 2021/0359462 A1 Nov. 18, 2021

(51) Int. Cl.

| | |
|---|---|
| ***H01R 24/38*** | (2011.01) |
| ***H01R 13/62*** | (2006.01) |
| ***H01R 31/06*** | (2006.01) |
| *H01R 103/00* | (2006.01) |

(52) U.S. Cl.
CPC ..... *H01R 13/6205* (2013.01); *H01R 24/38* (2013.01); *H01R 31/06* (2013.01); *H01R 2103/00* (2013.01)

(58) Field of Classification Search
CPC .... H01R 13/6205; H01R 24/38; H01R 31/06; H01R 13/22
See application file for complete search history.

(56) References Cited

U.S. PATENT DOCUMENTS 3,363,214 A * 1/1968 Wright ..... H01R 13/6205 439/39
3,521,216 A * 7/1970 Tolegian ..... H01R 13/6205 439/39

(Continued)

FOREIGN PATENT DOCUMENTS

CN 101351970 B 12/2011
CN 102314621 1/2012

(Continued)

OTHER PUBLICATIONS

CID XU, 1-Wire iButton UserGuide, Eddy Wireless Int'l Distributor, catalog, Jul. 9, 2012, pp. 5, Wireless Int'l Distributor.

(Continued)

*Primary Examiner* — Tho D Ta
(74) *Attorney, Agent, or Firm* — Conley Rose PC

(57) ABSTRACT

Examples disclosed herein provide an adapter. One example adapter includes first and second conductive contacts, and an insulative layer separating the first conductive contact from the second conductive contact. A first side of the adapter is to couple to a reader, and a second side opposite to the first side is to accommodate different sizes of data carriers that store information to be read by the reader via the first and second conductive contacts.

12 Claims, 2 Drawing Sheets

(56) References Cited

U.S. PATENT DOCUMENTS

| | | | | |
|---|---|---|---|---|
| 3,808,577 | A * | 4/1974 | Mathauser | H01R 13/6205 439/39 |
| 5,848,541 | A | 12/1998 | Glick et al. | |
| 6,917,102 | B2 | 7/2005 | Zhou et al. | |
| 6,939,177 | B2 | 9/2005 | Kato et al. | |
| 7,213,766 | B2 | 5/2007 | Ryan et al. | |
| 7,249,975 | B1 | 7/2007 | Liu | |
| 7,329,128 | B1 * | 2/2008 | Awad | H01R 13/6205 439/38 |
| 7,448,914 | B2 | 11/2008 | Calvas et al. | |
| 7,597,250 | B2 | 10/2009 | Finn | |
| 7,748,636 | B2 | 7/2010 | Finn | |
| 2006/0258180 | A1 * | 11/2006 | Kerekes | H01R 24/54 439/63 |
| 2017/0201041 | A1 * | 7/2017 | Hashiguchi | H01R 13/2428 |

FOREIGN PATENT DOCUMENTS

| | | | | |
|---|---|---|---|---|
| EP | 1577984 | | 9/2005 | |
| EP | 1577984 | A1 | 9/2005 | |
| EP | 2922153 | A1 * | 9/2015 | H01R 13/6205 |

OTHER PUBLICATIONS

IButton Dallas key reader 20mm hole diameter.
IButton Probes/Readers Without Wires for Customized Use.

* cited by examiner

DATA CARRIER ADAPTERS

BACKGROUND

Various authentication solutions are available for validating a user attempting to gain access to a computing device. One such authentication solution utilizes 1-Wire technology, which is a serial protocol using a single data line plus ground reference for communication, for example, that may be used for authenticating the user. As an example, each user authorized to gain access to the computing device may have an authentication device or data carrier known as an iButton, which is a mechanical packaging standard that places a 1-Wire component inside a stainless steel button.

DETAILED DESCRIPTION

In order to uniquely authenticate each user attempting to gain access to the computing device, iButtons may have a unique serial number, such as a 64-bit serial number, which gives each iButton a unique 1-Wire network address. In order to authenticate the user, the computing device may have a reader that makes contact with an iButton. For example, the reader may include conductive contacts that touch a "lid" and "base" of the iButton. Each iButton has a data contact, called the lid, and a ground contact, called the base, each contact connected to the 1-Wire component inside. With regards to the stainless steel button, the lid may correspond to a top portion of the button, and the base may correspond to the sides and bottom of the button, with an insulating layer separating the lid and base. The iButton may be connected to a 1-Wire bus system when the iButton makes contact with the reader. In order to ensure communication between the reader and iButton, dimensions of the reader and iButton may be taken into consideration.

Examples disclosed herein provide an adapter that can be coupled to the reader of the computing device, for accommodating different sizes of data carriers. As different sizes of data carriers, such as the iButton, may be used around the world, the adapter provides a universal solution for authenticating users, irrespective of the size of the iButton. As a result, a standard size reader, coupled to the universal adapter, may be used in combination to accommodate different sizes of iButtons.

Figure 1:
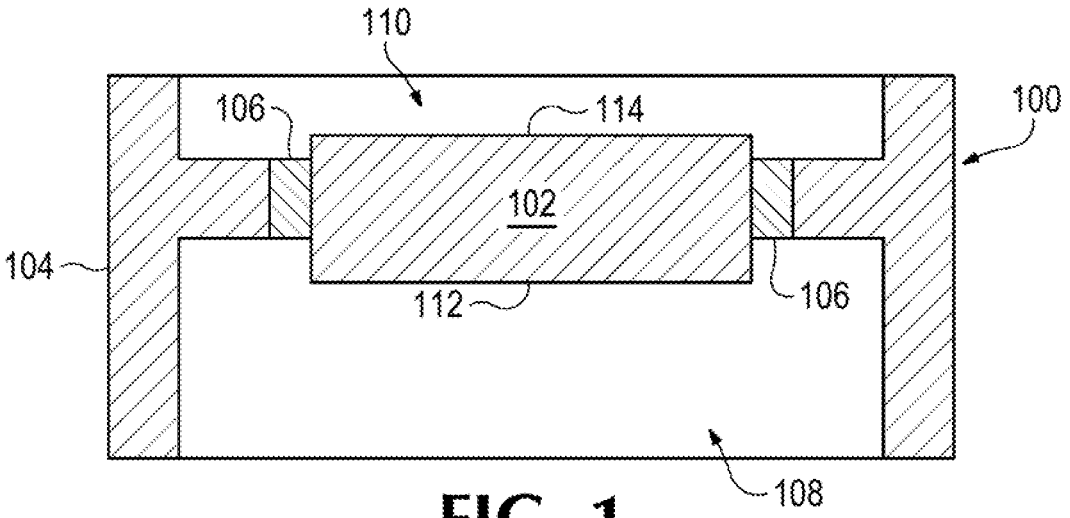
FIG. 1 illustrates a cross-sectional view of an adapter that can be coupled to a reader of a computing device, according to an example.

With reference to the figures, FIG. 1 illustrates a cross-sectional view of an adapter 100 that can be coupled to a reader of a computing device, according to an example. As will be further described, the adapter 100 provides the ability for accommodating different sizes of data carriers, such as iButtons, to be read by the reader. As a result, although a data carrier may be too big to be accommodated by the reader, the reader may be able to read data from the data carrier via the adapter 100.

As illustrated, the adapter 100 includes a first conductive contact 102, including a first side 112 and second side 114.

In addition, the adapter includes a second conductive contact 104. As will be further described, the first and second contacts 102, 104 may make contact with the lid and base of an iButton, in order to be read by the reader. In order for the first and second contacts 102, 104 to independently contact the lid and base of the iButton, the first and second contacts 102, 104 may be electrically isolated from each other by an insulative layer 106. As an example, a first side 108 of the adapter 100 can be coupled to the reader (e.g., see FIG. 2), and a second side 110 of the adapter 100 is to accommodate different sizes of data carriers (e.g., iButtons) that store information to be read by the reader, via the first and second conductive contacts 102, 104 (e.g., see FIGS. 3-4). As an example, the first conductive contact 102 of the adapter 100 allows a 1-Wire connection between the reader and iButton.

Figure 2:
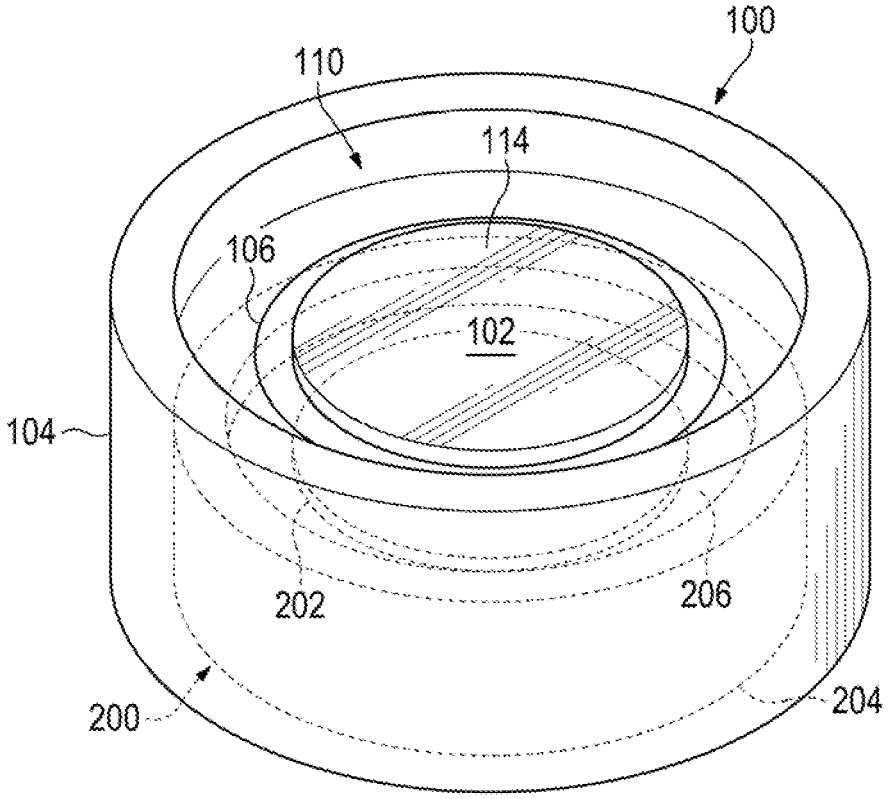
FIG. 2 illustrates a system including the adapter coupled to the reader, according to an example.

FIG. 2 illustrates a system including the adapter 100 coupled, to a reader 200, according to an example. Similar to the components of the adapter 100, the reader 200 includes a first conductive contact 202 and a second conductive contact 204 electrically isolated from each other via an insulative layer 206. As the adapter 100 is coupled to the reader 200, their respective components make contact with each other. For example, the first side 112 of the first conductive contact 102 of the adapter 100 makes contact with the first conductive contact 202 of the reader 200. Similarly, the second conductive contact 104 of the adapter 100 makes contact with the second conductive contact 204 of the reader 200. As the adapter 100 has a wider diameter compared to the reader 200, in order to accommodate different sizes of iButtons, the outside edge of the adapter 100 is grounded to the outside of the reader 200, as illustrated.

As an example, the adapter 100 may magnetically couple to the reader 200, in order to ensure proper alignment between them, and that they remain coupled to each other until an opposing force greater than the magnetic coupling is applied to remove the adapter 100 from the reader 200. As will be further described, as the first conductive contact 102 of the adapter 100 makes contact with the first conductive contact 202 of the reader 200, the adapter 100 may establish a single data line, such as a 1-Wire connection, between the reader 200 and an iButton coupled to the second side 110 of the adapter 100.

Figure 3:
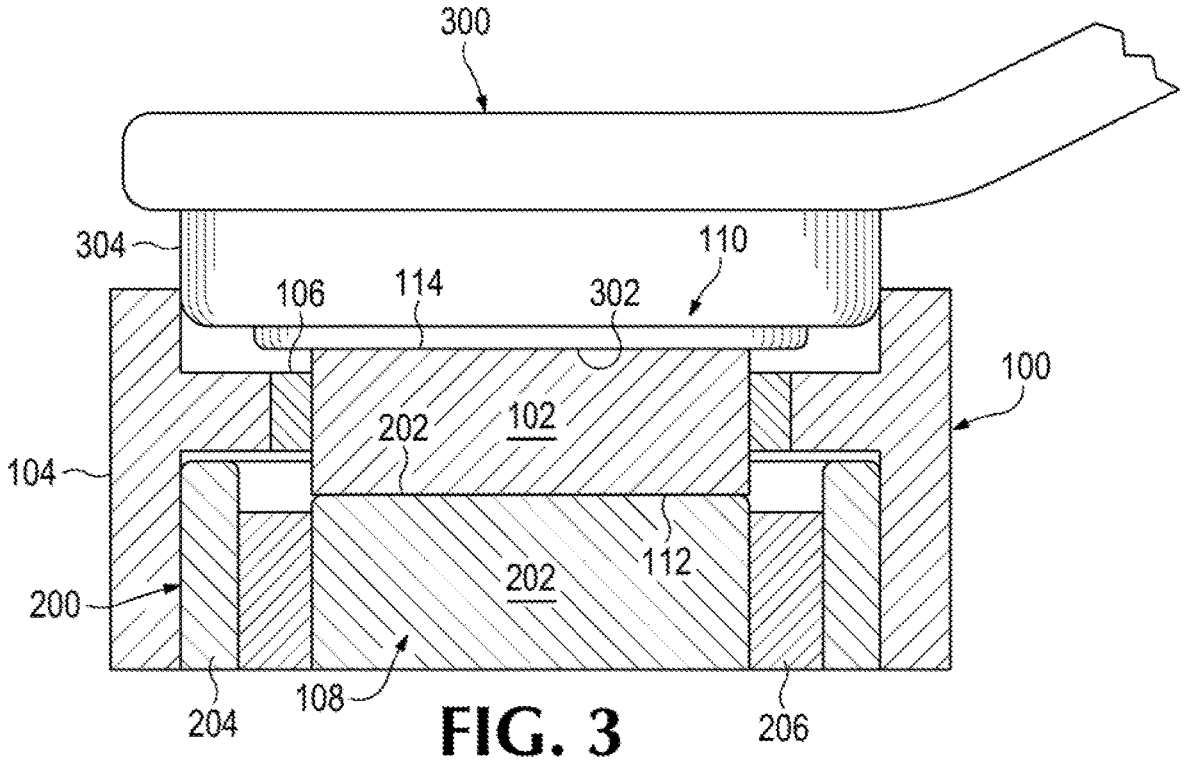
FIG. 3 illustrates a data carrier sized to match the dimensions of the adapter, according to an example.
Figure 4:
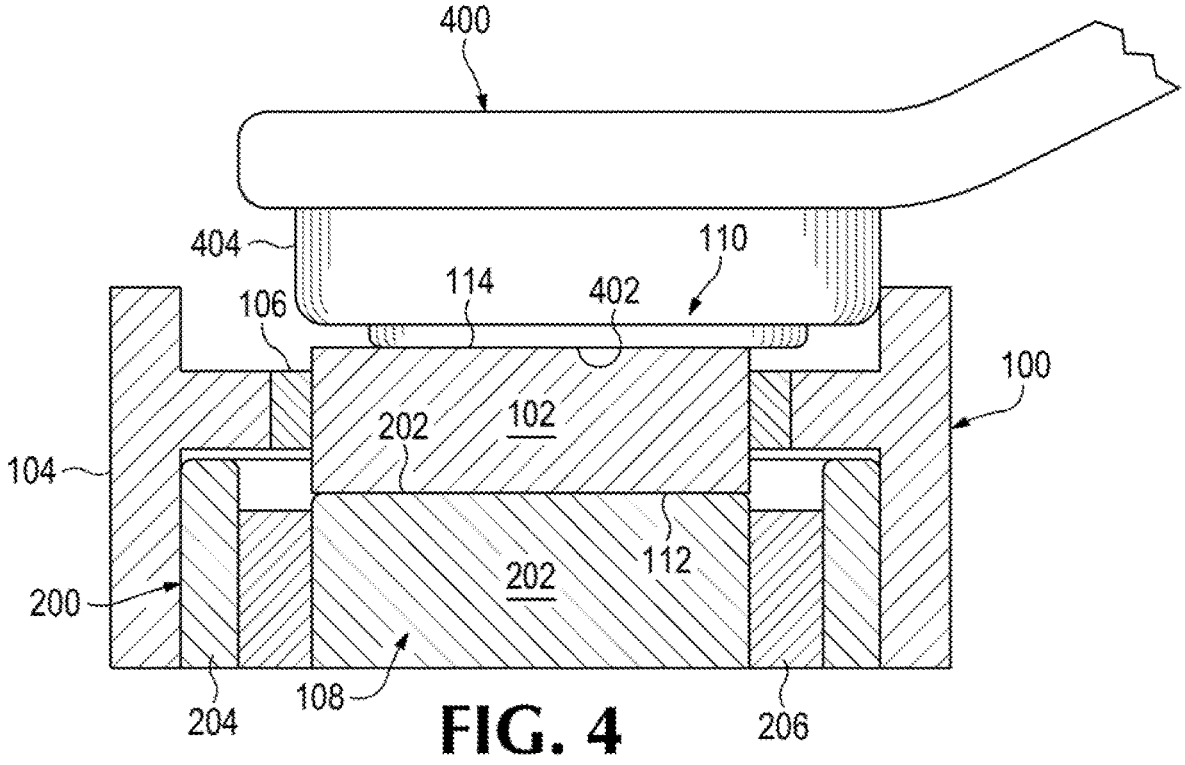
FIG. 4 illustrates another data carrier, according to an example.

FIGS. 3-4 illustrate cross-sectional views of the adapter 100 accommodating different sizes of data carriers, such as iButtons, in order to establish a single data line, such as a 1-Wire connection, between the reader 200 and the data carriers, FIG. 3 illustrates a data carrier 300 sized to match the dimensions of the adapter 100, according to an example. Similar to the adapter 100 and reader 200, the data carrier 300 includes a first conductive contact 302 (lid) and a second conductive contact 304 (base) electrically isolated from each other via an insulative layer (not shown), As the data carrier 300 is coupled to the adapter 100, their respective components make contact with each other. For example, the lid 302 of the data carrier 300 makes contact with the second side 114 of the first conductive contact 102 of the adapter 100, Similarly, the base 304 of the data carrier 300 makes contact with the second conductive contact 104 of the adapter 100. As the dimensions of the data carrier 300 match the dimensions of the adapter 100, the base 304 of the data carrier 300 makes contact along the whole circumference of the second conductive contact 104 of the adapter 100.

As illustrated, the first side 112 of the first conductive contact 102 of adapter 100 is exposed on the first side 108 of the adapter 100. Similarly, the second side 114 of the first conductive contact 102 of adapter 100 is exposed on the second side 110 of the adapter 100. By being exposed on either end, the adapter 100 is able to establish a single data line, such as a 1-Wire connection, between the first conductive contact 202 of the reader 200 and the first conductive contact 302 data carrier 300. As illustrated, the data carrier 300 will not be able to couple directly with the reader 200, due to the diameter of the base 304 of the data carrier 300. However, the larger diameter provided by the second conductive contact 104 of the adapter 100 allows for the establishment of the 1-Wire connection between the data carrier 300 and reader 200.

FIG. 4 illustrates another data carrier 400, according to an example. Similar to the adapter 100 and reader 200, the data carrier 400 includes a first conductive contact (lid) 402 and a second conductive contact (base) 404 electrically isolated from each other via an insulative layer (not shown). As mentioned above, different size iButtons may be used in different regions around the world. The larger diameter provided by the universal adapter 100, for example, compared to the diameter of the reader 200, accommodates these different size iButtons. As illustrated, the diameter of the second conductive contact 404 of the data carrier 400 is small enough to not occupy the whole area provided by the second side 110 of the adapter 100. However, in order to establish the 1-Wire connection between the data carrier 400 and reader 200, in addition to maintaining contact between the first conductive contact 402 of the data carrier 400 and the second side 114 of the first conductive contact 102 of the adapter 100, contact needs to be maintained between the second conductive contact 404 of the data carrier 400 and the second conductive contact 104 of the adapter 100. The smaller diameter of the second conductive contact 404 of the data carrier 400 will not allow for contact along the whole circumference of the second conductive contact 104 of the adapter 100.

As an example, magnetic coupling between the data carrier 400 and the adapter 100 may ensure the contact between the second conductive contact 404 of the data carrier 400 and the second conductive contact 104 of the adapter 100, as illustrated. Examples of the magnetic coupling may include the second conductive contact 404 of the data carrier 400 and the second conductive contact 104 of the adapter 100 both being magnetized, among other examples. For example, the second conductive contact 104 of the adapter 100 may include magnetic members knot shown) to magnetically couple with the second conductive contact 404 of the data carrier 400. As a result, when a data carrier with a smaller diameter is coupled to the adapter 100, this magnetic coupling ensures contact is, maintained between the conductive contacts, as illustrated, in order to establish the 1-Wire connection between the data carrier and the reader 200.

It should be understood that examples described herein below may include various components and features. It should also be understood that, in the following description, numerous specific details are set forth to provide a thorough understanding of the examples. However, it should be understood that the examples may be practiced without limitations to these specific details. In some instances, well known methods and structures may not be described in detail to avoid unnecessarily obscuring the description of the examples. Also, the examples may be used in combination with each other.

Reference in the specification to "an example" or, similar language means that a particular feature, structure, or characteristic described in connection with the example is included in at least one example, but not necessarily in other examples. The various instances of the phrase "in one example" or similar phrases in various places in the specification are not necessarily all referring to the same example.

It should be understood that the previous description of the disclosed examples is provided to enable any person skilled in the art to make or use the present disclosure. Various modifications to these examples will be readily apparent to those skilled in the art, and the generic principles defined herein may be applied to other examples without departing from the spirit or scope of the disclosure. Thus, the present disclosure is not intended to be limited to the examples shown herein but is to be accorded the widest scope consistent with the principles and novel features disclosed herein.

What is claimed is:

1. An adapter comprising:

a first conductive contact;

a second conductive contact surrounding the first conductive contact;

an insulative layer separating the first conductive contact from the second conductive contact;

a first side to couple the adapter to a reader; and a second side opposite to the first side, wherein the second side is to accommodate different sizes of data carriers that store information to be read by the reader via the first and second conductive contacts, wherein the second conductive contact comprises magnetic members to magnetically couple with the data carrier, to ensure that contact is established between the second conductive contact and the data carrier when the data carrier is to make contact with the second side of the first conductive contact.

2. The adapter of claim 1, wherein a first side of the first conductive contact is exposed on the first side of the adapter and a second side of the first conductive contact is exposed on the second side of the adapter.

3. The adapter of claim 2, wherein when the adapter is to be coupled to the reader, a first side of the first conductive contact and the second conductive contact are to make contact with the reader to establish a single data line between the reader and a data carrier coupled to the second side of the adapter.

4. The adapter of claim 3, wherein when the data carrier is to be coupled to the second side of the adapter, the second side of the first conductive contact and the second conductive contact are to make contact with the data carrier.

5. A system comprising:

a reader; and an adapter comprising:

a first conductive contact;

a second conductive contact surrounding the first conductive contact;

an insulative layer separating the first conductive contact from the second conductive contact;

a first side to couple the adapter to the reader;

a second side opposite to the first side, to accommodate a data carrier, wherein the second conductive contact comprises magnetic members to magnetically couple with the data carrier, to ensure that contact is established between the second conductive contact and the data carrier.

6. The system of claim 5, wherein a first side of the first conductive contact and the second conductive contact are exposed on the first side of the adapter and a second side of the first conductive contact is exposed on the second side of the adapter.

7. The system of claim 6, wherein the first side of the first conductive contact and the second conductive contact are to make contact with the reader to establish a single data line between the reader and the data carrier coupled to the second side of the adapter.

8. The system of claim 6, wherein when the data carrier is to be coupled to the second side of the adapter, a second side of the first conductive contact and the second conductive contact are to make contact with the data carrier.

9. An adapter comprising:

a first conductive contact;

a second conductive contact surrounding the first conductive contact;

an insulative layer separating the first conductive contact from the second conductive contact;

a first side to couple the adapter to a reader; and a second side opposite to the first side, to accommodate a data carrier, wherein the second conductive contact comprises magnetic members to magnetically couple with the data carrier, to ensure that contact is established between the second conductive contact and the data carrier.

10. The adapter of claim 9, wherein a first side of the first conductive contact and the second conductive contact are exposed on the first side of the adapter and a second side of the first conductive contact is exposed on the second side of the adapter.

11. The adapter of claim 10, wherein when the adapter is to be coupled to the reader, the first side of the first conductive contact and the second conductive contact are to make contact with the reader to establish a single data line between the reader and the data carrier coupled to the second side of the adapter.

12. The adapter of claim 11, wherein when the data carrier is to be coupled to the second side of the adapter, a second side of the first conductive contact and the second conductive contact are to make contact with the data carrier.

* * * * *